US009307827B2

(12) United States Patent
Brewer

(10) Patent No.: US 9,307,827 B2
(45) Date of Patent: Apr. 12, 2016

(54) REPLACEMENT INDICATING WORKPIECE

(71) Applicant: L'Oreal, Paris (FR)

(72) Inventor: Gerald Keith Brewer, Redmond, WA (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 14/731,268

(22) Filed: Jun. 4, 2015

(65) Prior Publication Data

US 2015/0359324 A1 Dec. 17, 2015

Related U.S. Application Data

(62) Division of application No. 14/304,478, filed on Jun. 13, 2014, now abandoned.

(51) Int. Cl.

| | |
|---|---|
| ***A46B 13/02*** | (2006.01) |
| ***A46B 15/00*** | (2006.01) |
| ***A46B 13/00*** | (2006.01) |
| ***A47K 7/04*** | (2006.01) |

(52) U.S. Cl.

CPC ..... *A46B 15/001* (2013.01); *A46B 13/008* (2013.01); *A46B 13/02* (2013.01); *A47K 7/04* (2013.01); *A46B 2200/102* (2013.01); *Y10S 15/11* (2013.01)

(58) Field of Classification Search

CPC ..... A46B 7/00; A46B 7/06; A46B 7/08; A46B 9/00; A46B 9/02; A46B 9/04; A46B 9/06; A46B 13/00; A46B 13/008; A46B 13/02; A46B 15/00; A46B 15/001; A46B 15/0038; A46B 2200/1006; A46B 2200/102

USPC ..... 15/22.1, 22.2, 23, 28, 105, 159.1, 160, 15/167.1, 180, DIG. 11

See application file for complete search history.

(56) References Cited

U.S. PATENT DOCUMENTS

| | | | | |
|---|---|---|---|---|
| 3,196,299 | A * | 7/1965 | Kott | 310/81 |
| 5,652,990 | A * | 8/1997 | Driesen et al. | 15/28 |
| 5,860,183 | A * | 1/1999 | Kam | 15/167.1 |
| 2002/0088068 | A1 | 7/2002 | Levy | |
| 2015/0189980 | A1 | 7/2015 | Hwang | |

FOREIGN PATENT DOCUMENTS

| | | | |
|---|---|---|---|
| GB | 2 323 026 | A | 9/1998 |
| JP | 2009240768 | A | 10/2009 |
| WO | 2004/002267 | * | 1/2004 |
| WO | 2013/191389 | A1 | 12/2013 |

OTHER PUBLICATIONS

International Search Report mailed Sep. 10, 2015, issued in corresponding International Application No. PCT/US2015/035865, filed Jun. 15, 2015, 5 pages.

Written Opinion of the International Searching Authority mailed Sep. 10, 2015, issued in corresponding International Application No. PCT/US2015/035865, filed Jun. 15, 2015, 10 pages.

* cited by examiner

*Primary Examiner* — Mark Spisich

(74) *Attorney, Agent, or Firm* — Christensen O'Connor Johnson Kindness PLLC

(57) ABSTRACT

A wear indicator is provided, which is suitable for use with a workpiece, such as a replaceable brush head. In use, the wear indicator can provide an indication to the user recommending that the workpiece be replaced.

14 Claims, 8 Drawing Sheets

REPLACEMENT INDICATING WORKPIECE

CROSS-REFERENCE TO RELATED APPLICATION

The present application is a division of U.S. patent application Ser. No. 14/304,478, filed Jun. 13, 2014 under 35 USC§120 now abandoned, the disclosure of which is hereby incorporated by reference in its entirety.

BACKGROUND

Motorized skin care devices are currently used to cleanse, exfoliate, and massage a subject's skin. Typically, these skin care devices include a replaceable workpiece selectively coupled to a personal care appliance. The workpiece, sometimes referred to as a head, includes an applicator that applies a skin care treatment to the subject's skin. The personal care appliance imparts motion to the workpiece in order to increase the effectiveness of the treatment. Commercially available skin care devices typically employ either rotational or oscillatory motion.

In several popular skin care devices on the market today, the applicator includes one or more bristled tufts, and is sometimes referred to as a brush head. During use, the bristles of the brush heads can become damaged based on repetitive contact with the subject's skin. The bristles can also lose their effectiveness due to the presence of dirt, make-up, etc. Further, since these devices are used in wet conditions and are subject to contact with human beings, undesirable bacteria, fungus, flora and/or fauna may eventually be present on the brush head over time.

Most users do not know when to replace the brush heads of their skin care device, and thus, usually use the brush device way beyond its intended lifespan. Accordingly, many manufacturers have a recommended replacement period for the brush heads to address this problem. While successful with some clientele, other remedies are desired to assist users to replace the brush heads at the appropriate time.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present disclosure, an apparatus, such as a skin brush head for use with a motorized personal appliance, is provided. The skin brush head includes a body having an outer surface and a treatment applicator coupled to the outer surface of the body. The treatment applicator in some embodiments is configured to apply treatment to a subject's skin. The skin brush head also includes a wear indication member configured to move to an indicating position with respect to the treatment applicator that indicates to a user a recommendation for replacement of the skin brush head after an amount of usage of the skin brush head.

In accordance with another aspect of the present disclosure, an apparatus, such as a removable workpiece for use with a motorized personal appliance, is provided. The workpiece includes a body having an outer surface and a treatment applicator coupled to the outer surface of the body. The treatment applicator in some embodiments is configured to apply treatment to a subject's skin. The workpiece also includes means for providing an indication to a user recommending replacement of the workpiece after an amount of usage of the workpiece. In one embodiment, the means for providing an indication includes a member movable to a deployed position in which the member is adjacent an outer end of the treatment applicator.

In accordance with yet another aspect of the present disclosure, an apparatus, such as a powered treatment device, is provided. The device includes a powered handle having a motor and a skin brush head selectively mounted to the powered handle and configured to be moved by the motor. The skin brush head in some embodiments includes a body having an outer surface, a plurality of bristles extending outwardly from the outer surface of the body, and a wear indicator associated with the brush head. The wear indicator in some embodiments includes a is configured to provide an indication to a user recommending replacement of the facial cleansing brush head after an amount of usage of the skin brush head a wear indication member configured to move to an indicating position with respect to the plurality of bristles for indicating to a user a recommendation for replacement of the skin brush head after an amount of usage of the skin brush head.

DESCRIPTION OF THE DRAWINGS

The foregoing aspects and many of the attendant advantages of this disclosed subject matter will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following discussion provides examples of devices that relate to skin care, and more particularly, to replaceable brush heads suitable for used with a personal care appliance for skin treatment of any exterior body part of a subject. Examples of the replaceable brush heads include a wear indicator, which can provide an indication to the user recommending that the workpiece be replaced.

In some examples, the wear indicator is a colored material layer that is printed, dipped, painted or otherwise applied to a plurality of bristle tips of at least one section of the brush. The material layer, once applied, can be in the form of picture, such as a flower, a pattern, such as a ring, or indicia, such as symbols, letters, numbers or words. In some embodiments, this material layer or coating wears or fades via abrasion, loss of adhesion, solubility, etc., and combinations thereof, thereby indicating a need for replacement. In other embodiments, this material layer or coating wears or fades via abrasion, loss of adhesion, solubility, etc., and combinations thereof, which can reveal the color of the substrate, such as the bristles, brush body, etc., thereby indicating a need for replacement. In yet other embodiments, the material layer or coating is removed over time via abrasion, diminishing adhesion, solubility, etc., and combinations thereof, to reveal a second underlying material layer or coating, which presents a word, a symbol or another indicator that is indicative of a recommendation for replacement. Still in other examples, the wear indicator can be a pop-up device, which indicates a need for replacement.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

Figure 1:
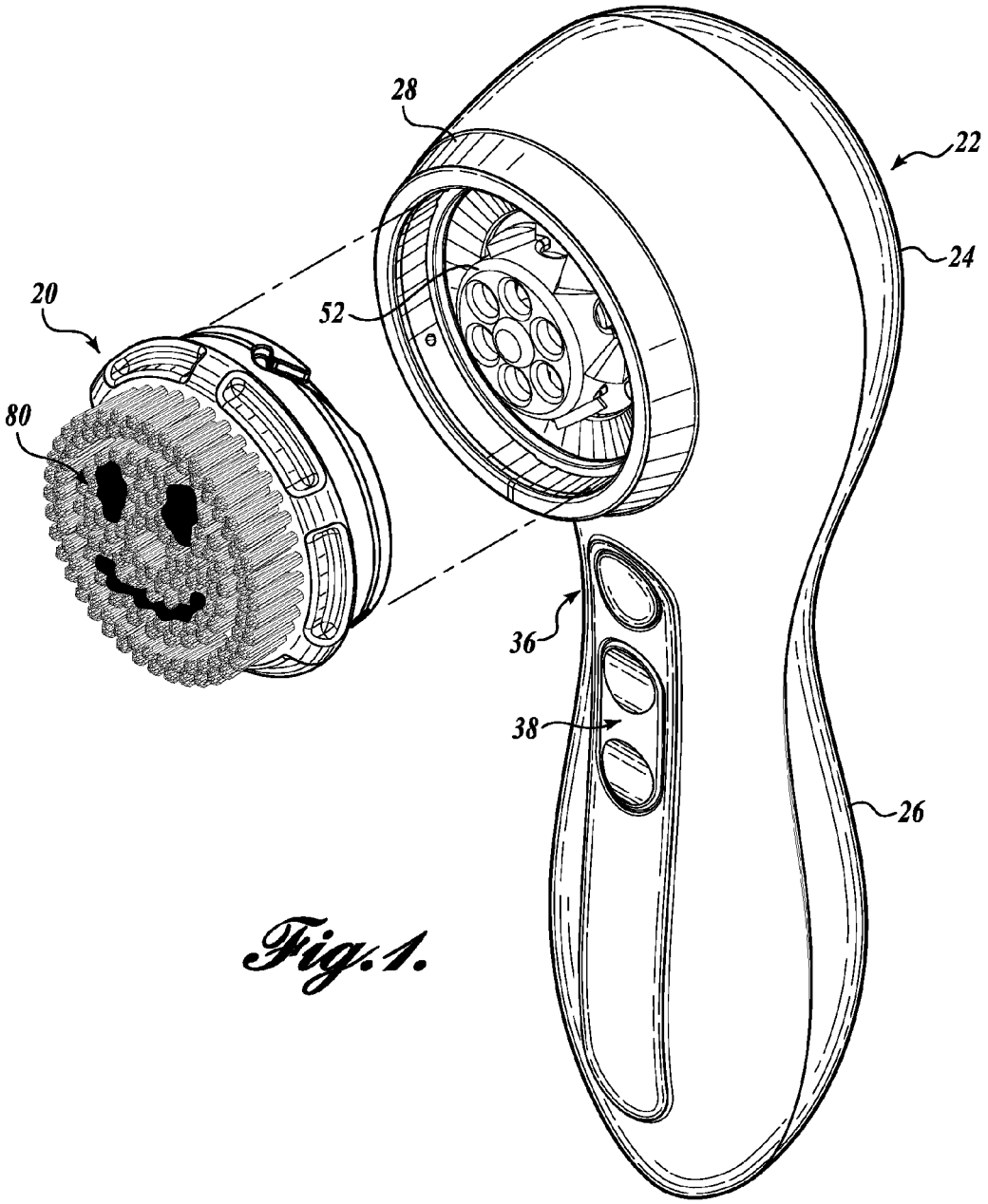
FIG. 1 is an isometric view of one example of a brush head in accordance with aspects of the present disclosure, the brush head exploded from a suitable personal care appliance.
Figure 3:
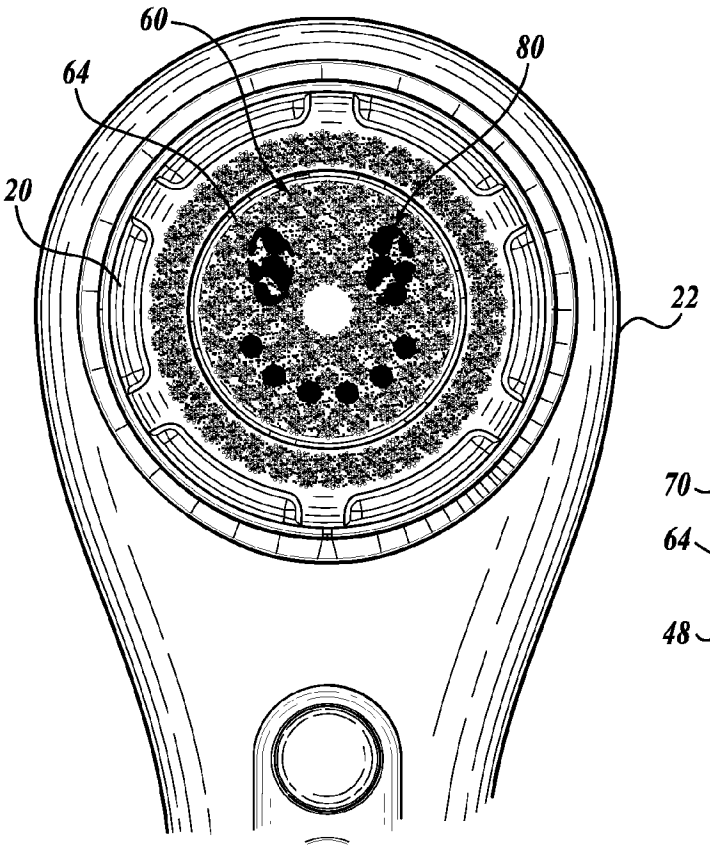
FIG. 3 is a top view of a brush head coupled to a personal care appliance, the brush head having one example of a wear indicator in accordance with aspects of the present disclosure.

Turning now to FIG. 1, there is shown one example of a workpiece, generally designated 20, formed in accordance with aspects of the present disclosure. The workpiece 20 is suitable for use with a personal care appliance, such as appliance 22. In the embodiment shown, the workpiece 20 is in the form of a skin brush head (hereinafter "brush head 20"). As will be described in more detail below, the brush head 20 also includes a wear indicator 80, which provides a visual cue to the user that recommends replacement of the brush head 20, as shown for example in FIG. 3. In use, the brush head 20 can be rotated, reciprocated, oscillated, etc., by the personal care appliance 22 over a subject's skin in order to apply a treatment, e.g., cleanse, massage, exfoliate, etc., to the subject's skin.

Figure 2:
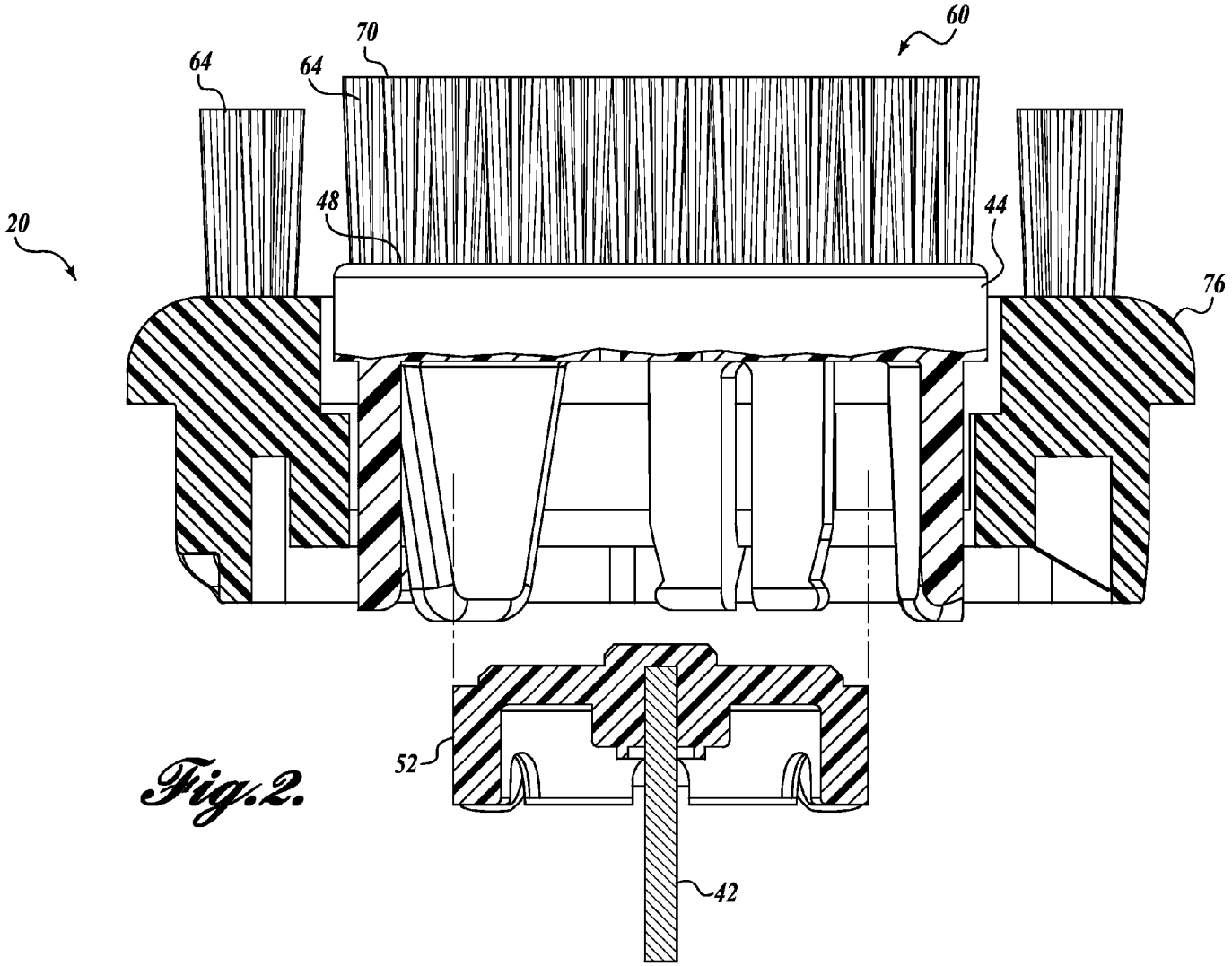
FIG. 2 is a cross sectional view of the brush head of FIG. 1.

Turning now to FIGS. 1-2, one example of the brush head 20 will be described in more detail. As shown in FIG. 2, the brush head 20 includes a body 44 having an outwardly facing outer surface 48. In the embodiment shown, the body 44 has a generally cylindrical cross-section, although other geometrical cross-sections (i.e. triangular, elliptical, lobular, square, etc.) may be employed. The body 44 can be constructed out of plastic, such as nylon, polypropylene, polyurethane, polyethylene, etc., although other materials may be utilized, including lightweight metals, such as aluminum, titanium, etc. As will be described in more detail below, the body 44 can be configured to interface directly or indirectly with a component, such as for example a drive boss 52, of the personal care appliance 22.

The brush head 20 includes a treatment applicator coupled to outer surface 48 of the body 44 and extending outwardly therefrom. In some embodiments, the treatment applicator is in the form of, for example, a plurality of bristles 64, as shown in FIG. 1. The plurality of bristles 64 can be spaced apart, or in the embodiment shown in FIG. 1, the plurality of bristles 64 can be grouped together (e.g., 20-180 bristles) to form one or more tufts 60. In either case, the bristles 64 extend upwardly from the outer surface 48 of the body 44 and terminate as bristle tips 70. The bristles 64 in some embodiments of the present disclosure have a length of about 0.20 inches (5.08 millimeters) to about 1.2 inches (30.48 millimeters) or greater and a diameter in the range of about 0.002 inches (0.0508 millimeters) to about 0.020 inches (0.508 millimeters) or greater. In some embodiments, one group of bristles can have a longer length than another group of bristles. One example of a brush head with bristles of varying lengths is described in co-pending U.S. application Ser. No. 13/862,280, filed Apr. 12, 2013. The bristles 64 can be constructed out of a variety of materials, including but not limited to elastomers, co-elastomers, polymers, co-polymers, and blends or combinations thereof, etc.

In some embodiments, one or more of the bristles 64 may be constructed out of polybutylene terephthalate (PBT) polyester or a TPE/PBT blend, such as DuPont™ Tynex®, Supersoft Hytrel® thermoplastic elastomer filaments or DuPont™ Natrafil® polyester with texturing additives with high performance suitable for sonic applications. Filaments with differing bending and ink adhesion characteristics, such as DuPont™ Tynex® nylon of differing blends (i.e. 6, 6.10, 6.12 etc.), can be also be selected depending on its intended application and desired adhesion characteristics, as will be discussed in more detail below. Other DuPont™ Tynex® nylon may be employed to construct the filaments, including DuPont™ Tynex® PTFE. DuPont™ Tynex® PTFE is Nylon 6.12 (i.e. 0906) loaded with an additive to provide a slippery feel, which again provides another adhesion variable suitable for the inner, intermediate, or outer material layers, as will be discussed below. In other embodiments, the bristles can be constructed out of or include an elastomer. One such example includes an elastomeric (e.g., TPE) inner core and a polymer (e.g., PBT) outer jacket. Although DuPont materials are mentioned herein with their trade names, it is understood that generic equivalents and variations may be suitable for use also, such as; polypropylene, polyethylene, such as DuPont™ Bynel®, with combinations or blends thereof, etc.

In some embodiments, the bristles 64 may have cross sections including but not limited to solid round, hollow, rectangular, diamond, hollow, rectangular, X-shape, quadralobal, including textured surface etc. Additives may be added that can either enhance sonic resonance characteristics, or provide extra benefits such as silver zeolite for antibacterial effects. Additives may also be used to modify the surface energy of the filaments and control the surface energy, as will be described in more detail below.

Still referring to FIG. 2, the brush head 20 in some embodiments may also include an optional outer retainer 76. The outer retainer 76 forms a central, cylindrically shaped opening that is sized and configured to surround the body 44. In some embodiments, a plurality of bristles 64 extend from the outer surface of the outer retainer 76. In yet other embodiments the retainer 76 may be absent of bristles (e.g., filaments) and have a more decorative design. The body 44 and the outer retainer 76 together include an attachment system in some embodiments that is configured to provide selective attachment of the brush head 20 to the personal care appliance 22.

Figure 5:
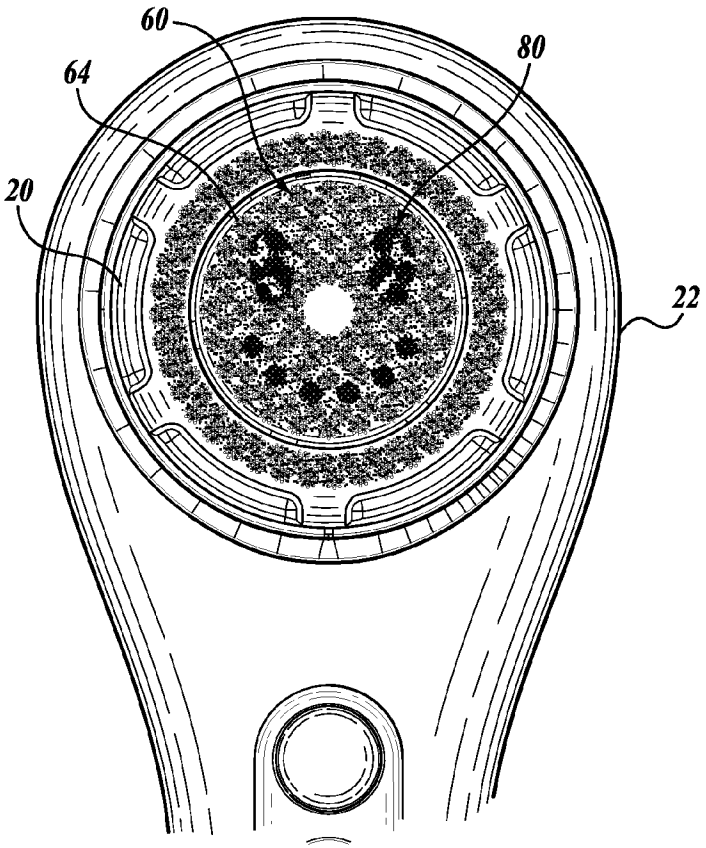
FIG. 5 is a is a top view of the brush head coupled to a personal care appliance of FIG. 3 wherein the wear indicator has faded and/or partial removed over time based on use of the brush head.
Figure 4:
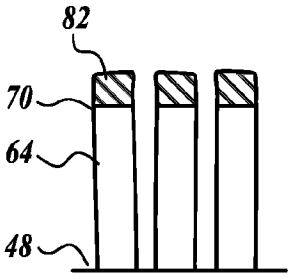
FIG. 4 is an enlarged schematic view of a plurality of bristles, each bristle having a material layer disposed thereon in the form of a wear indicator.

As briefly described above, the brush head 20 further includes a wear indicator 80, as shown in FIG. 1. In the embodiment shown in FIGS. 3-5, the wear indicator 80 includes a colored material layer 82 (see FIG. 4) disposed on a plurality of bristles 64, tufts 60, or portions thereof. The colored material layer 82 can be printed, dipped, painted or otherwise applied to the bristle tips 70 in one or more sections the brush head. In that regard, the material layer 82 in some embodiments can be in the form of picture, such as a flower, a pattern, such as a ring, or indicia, such as symbols, letters, numbers or words, among others. In other embodiments, the colored material layer 82 can be a solid color, such as for example, white, red, blue, etc.

In some embodiments, the material layer 82 can be configured to wear or fade, thereby indicating a need for replacement. In other embodiments, the material layer 82 can be configured to wear or fade, which can reveal the color of the substrate, such as the bristles 64, body 44, etc., thereby indicating a need for replacement. In some embodiments, fading can be caused by abrasion against the skin or hair of a subject. Additionally or alternatively, fading can be based on its interaction with a liquid, such as for example, water, cleansing agents, skin care formulations, etc. In some these embodiments, the material layer 82 can include a polyvinyl alcohol, such as Elvanol, and can be, for example, approximately <0.1 mm thick. Further still, fading can be caused by a loss of or diminishing adhesion between the material layer 82 and the underlying substrate, for example, the bristle tips 70.

Figure 8:
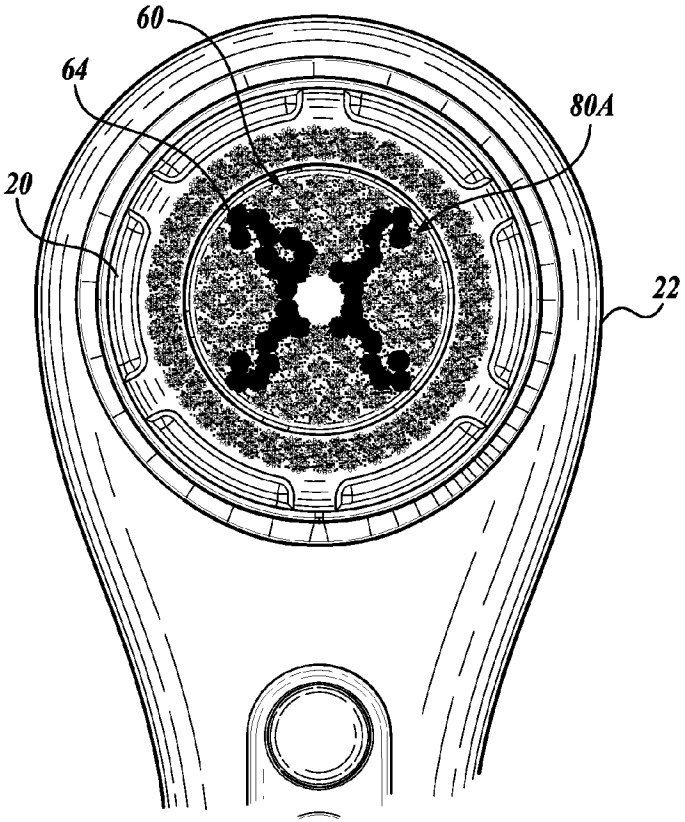
FIG. 8 is a top view of the brush head coupled to a personal care appliance of FIG. 6 wherein the outer layer has been removed over time via use in order to show the inner material layer which provides an indication that the brush head is in need of replacement.
Figure 7:
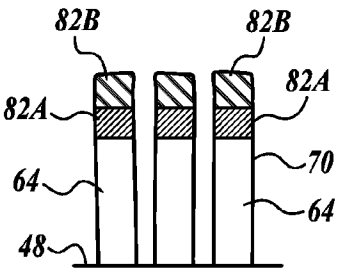
FIG. 7 is an enlarged schematic view of a plurality of bristles, each bristle having an inner material layer and an outer material layer disposed thereon forming a wear indicator.
Figure 6:
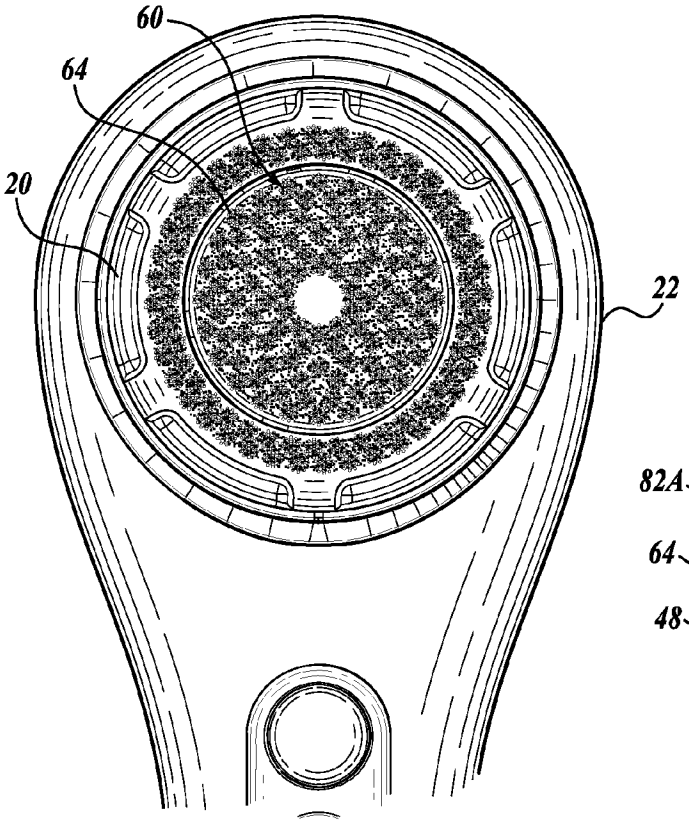
FIG. 6 is a top view of a brush head coupled to a personal care appliance, the brush head having another example of a wear indicator in accordance with aspects of the present disclosure.

In accordance with another aspect of the present disclosure, the wear indicator 80 can be comprised of multiple layers 82A, 82B disposed on the plurality of bristles 64, tufts 60, or portions thereof. In the embodiment shown in FIGS. 6-8, a first material is printed, dipped, painted or otherwise applied to the bristle tips 70 on one or more sections of the brush head to form a first or inner material layer 82A. In that regard, the first material layer 82A can be in the form of or include a symbol or words indicating a need for brush head replacement. In the embodiment shown, the first or inner layer 82A forms an "X" symbol, which can be revealed to depict, for example, a universal symbol to replace the brush head. In another embodiment, inner layer 82A may spell out a word, such as for example "REPLACE," as an instructional message to the user. A second material is then printed, dipped painted or otherwise applied to at least cover the first or inner material layer 82A, thereby forming a second or outer material layer 82B. Once applied, the second or outer material layer 82B hides or obfuscates the message or indicator formed by the first or inner layer 82A. In some embodiments, the second or outer layer 82B can be a solid color, such as red, blue, green, etc., a covering pattern, a picture, etc.

In these embodiments, the material of the first or inner material layer 82A can be chosen so as to achieve near permanent adhesion and resistance to wear. Examples of materials that can be used to form the material layer 82A are acrylated monomers, acrylated oligomers, amine acrylates, acrylic esters, just to name a few. These materials can be UV curable. In some embodiments, the material layer 82A can be formulated as a printable ink so as to be applied to the bristle tips 70 of the brush head 20 via a commercially available inkjet type printer. It will be appreciated that other application techniques, including painting, dipping, etc., can be employed to apply the material in order to form the material layer 82A.

In some embodiments, the material layer 82B can be configured to wear or fade, which can reveal the color of the substrate, such as the first material layer 82A, etc., thereby indicating a need for replacement. In some embodiments, fading can be caused by abrasion against the skin or hair of a subject. Additionally or alternatively, fading can be based on its interaction with a liquid, such as for example, water, cleansing agents, skin care formulations, etc. In some these embodiments, the material layer 82 can include a polyvinyl alcohol, such as Elvanol, and can be, for example, approximately <0.1 mm thick. Further still, fading can be caused by a loss of or diminishing adhesion between the material layer 82B and the underlying substrate, for example, the material layer 82A. In other embodiments, a contaminating layer (not shown) can be disposed in-between the inner and outer layers 82A, 82B to lessen the adhesion therebetween, allowing the outer, second layer 82B to separate from the inner, first layer 82A as the brush head 20 is used over time.

In accordance with another aspect of the present disclosure, the wear indicator 80 can be formed at least in part by the bristle tips 70 or portions thereof in conjunction with a material layer, such as material layer 82 or 82B described above with reference to FIGS. 3A-3C. For example, in some embodiments, the material layer 82 can be applied to colored or dyed bristle tips 70. In these embodiments, the color of the applied material layer 82 is different than the bristle tips 70. In use, as the material layer 82 wears down, loses adhesion or otherwise fades, etc., the colored bristle tips 70 become visual, indicating to the user a recommendation for brush head replacement. In other embodiments, a select group of bristle tips 70 are colored (e.g., dyed) in order to form a symbol, such as the "X", or a word, such as "Replace," as described above. In these embodiments, the material layer, such as material layer 82 or 82B, overlays the colored bristle tips 70. It should be appreciated that the applied material layer 82 or 82B in these embodiments can have any color so as long as the material layer 82 covers up, hides or obfuscates the colored bristle tips. In use, as the material layer 82 or 82B wears down, loses adhesion, or otherwise fades, etc., the symbol, word, etc., formed by the bristle tips become visual, indicating to the user a recommendation for brush head replacement. It will be appreciated that the bristle tips can be dyed in a conventional manner.

As discuss above, the wear indicator 80 can be configured such that wear is controlled at least in part by the adhesion between the material layer and the bristle tips 70 (e.g., substrate), between inner and outer material layers 82A, 82B, or between the material layer 82 and the body 44. In that regard, one of ordinary skill understands that the surface tension and the comparative surface energy of a material determine the strength of a bond existing between a coating (material layer) and the substrate (e.g., filament material being coated, inner material layer, top surface of body, etc.). If a solid possesses high levels of surface energy as compared to the surface tension of a liquid (i.e. ink, paint, etc.), there will be increased molecular attraction resulting in increased molecular attraction between the ink, paint, etc., yielding a superior bond. To accomplish suitable levels of adhesion for realizing one or more aspects of the present disclosure, the substrate surface energy should range at least 5 mN/m (dyne/cm) above the surface tension of the adhesive, ink, paint, etc., used as the surface coating.

It will be appreciated that controlling the adhesion between the material layer 82 and the substrate (bristle tips 70, inner material layer 82A, body 44, etc.) can be realized simply by the selection of materials used to construct the material layer and the substrate. Varying the substrate surface energy with respect to the surface tension of the material layer 82 via selection of materials allows for varying adhesion strengths, and as a result, provides a means for varying the period of time to reflect, for example, the prescribed use period of a product. In some embodiments, either the bristle 64 or the material layer 82, or both, may carry an additive to help control the amount of adhesion between the filament and the particular ink, paint or coating. In some embodiments, a latex can be mixed with an acrylic formulated ink, which can cause a layering effect within that layer which may be configured to provide an adhesion weakness suitable to promote a bond failure between material layers 82B and 82A. The surface energy difference between acrylic with and without latex may range between 2 dynes/cm and 5 dynes/cm.

It will be appreciated that other techniques may be additionally or alternatively employed to affect the adhesion between materials. For example, various surface treatments to the substrate can be carried out in order to control the adhesion characteristics between the substrate and the material layer (i.e., surface coating). In some embodiments, a surface treatment such as high voltage corona and plasma surface activation can increase the surface energy level making it greater than the surface tension of the coating, printing ink, paint or adhesive so as to increase the chemical attraction. Such techniques may be useful, for example, with low surface energy materials such as High-Density Polyethylene, Polypropylene, EPDM and polyethylene, etc.

In other embodiments, the substrate surface treatments can be in the form of bristle tip finishing techniques, such as for example, end rounding, in order to vary, and thus, control the adhesion characteristics between the material layer 82 and the substrate. For example, the slickness of various materials, such as polypropylene, polyethylene, PTFE treated nylons, etc., can make adhesion extremely difficult in some embodiments because they lack a "tooth" (i.e., a mechanical interface that includes pits, grooves, channels, or other 3D texture), for the material layer to adhere to. Accordingly, the bristle tips 70 can be treated in order to form a preselected degree of tooth for the material layer to adhere to for a selected period of time. In some embodiments, the treatment reduces the degree of tooth of the substrate, while in other embodiments, the treatment increases the degree of tooth of the substrate. In some embodiments, both the selection of materials and substrate surface treatment is employed in order to provide adhesion for a selected period of time.

Accordingly, one or more adhesion factors when controlled provides a technique or means for allowing printed, dipped, painted or otherwise applied paints, inks, etc., to wear (e.g., rub off, fade, or be removed, etc.) over time. This capability can be advantageously utilized to provide an indication of wear by revealing a substrate yielding a recognizable symbol, word, color, etc., indicative of brush replacement. In some embodiments, the use of an intermediate layer or coating can be optionally employed to provide an adhesion interface for controlling the degree of adhesion. For example, an intermediate layer or coating, such as such latex, oils, including vegetable oil, etc., disposed between the substrate and the material layer can help match the energy levels and provide material layers (e.g., coatings of ink, paint, etc.) that will adhere, yet be capable of removal over time.

In one representative embodiment, a UV curable inkjet ink was applied to the monofilament tips of polybutylene terephthalate (PBT) polyester or a TPE/PBT blend, such as DuPont™ Tynex®, Supersoft Hytrel® thermoplastic elastomer filaments. Prior to ink application, the filament tips were treated with an end rounding process in order to provide a suitable surface interface or "tooth" for the initial adhesion to the substrate. In this embodiment, an intermediate layer or coating can be optionally employed to provide an adhesion interface for controlling the degree of adhesion between the UV curable ink and the bristle tips.

In addition to controlling the filament or coating material and/or surface treatment of the substrate in order to control the adhesion effect, other options may also exist. For example, some embodiments may control the wax content of the inks. When the wax content of two inks is similar they may not fully adhere. On the other hand, when one ink is waxy and the other is wax-free, the surface energy is higher and improved adhesion is created. In other embodiments, the carrier fluid in the inks can be adjusted (e.g., reduced). This may cause an incompatibility between the ink and the substrate, even though the ink may be formulated for the specific type substrate. This enables the applied ink to be more easily scratched off to reveal the substrate below. Additionally, the use of solvent based inks and water solvent inks may also be used to control the desired surface energy. Further, when the substrate energy is increased using plasma treatment the first layer of ink is also strengthened. By not treating the first layer of applied ink, the interlayer bond between the first layer and the second layer of ink will have reduced adhesion, thus making the outer ink layer easier to be removed.

Inkjet inks that represent some examples of the types of materials discussed herein are manufactured by Pad Print Machinery, East Dorset, Vt. (i.e. PLTIJ-CJ #60white, #65 black, #1 cyan, #2 Magenta and #3 Yellow). Equipment for application of these and other inks are also commercially available from provided by Pad Print Machinery. Although these specific inks and equipment are utilized for the samples, other inks and equipment are suitable for embodiments of the present disclosure.

Figure 9:
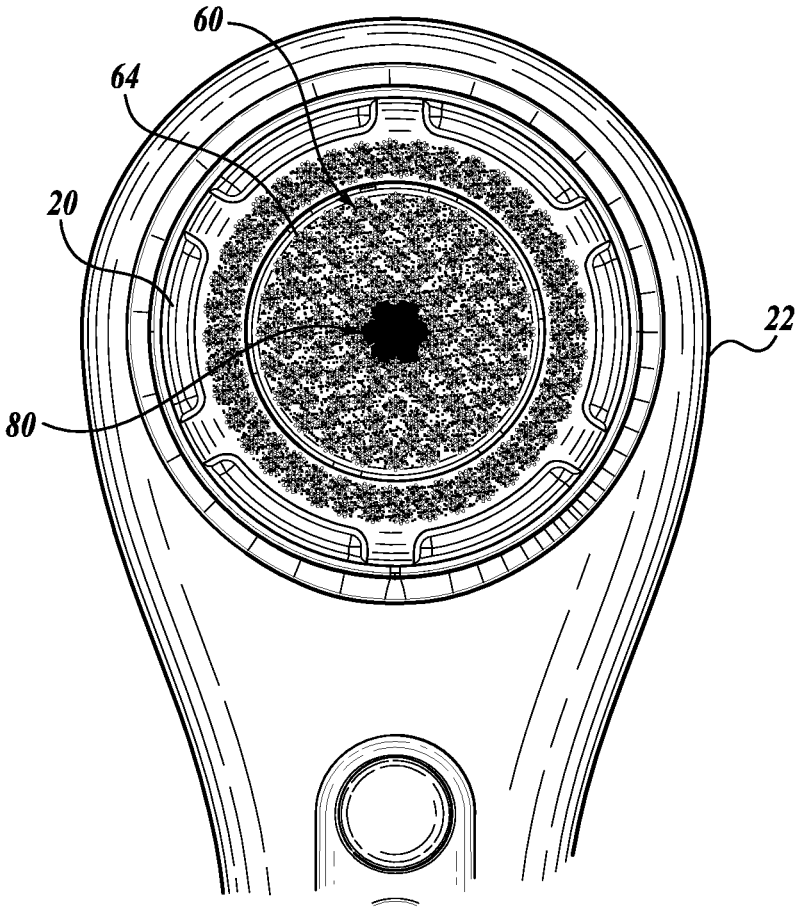
FIG. 9 is a top view of another example of a brush head having a wear indicator in accordance with aspects of the present disclosure.

While the embodiments of the wear indicator 80 described thus far have been disposed on the bristles 64 of the brush head 20, other embodiments of the brush head 20 are contemplated. For example, components of the wear indicator 80, such as material layer 82 or material layers 82A, 82B, can be printed, painted or otherwise applied directly or indirectly to one or more sections (e.g., central area, etc.) of the outer surface 48 of the body 44, as best shown in FIG. 9. In these or other embodiments, one or more of the wear factors can be controlled, including the material or materials selected for the body or top surface thereof and the material layers can be specifically selected, in order to achieve the desired wear patterns vs. time relationship in accordance with aspects of the present disclosure.

Figure 10A:
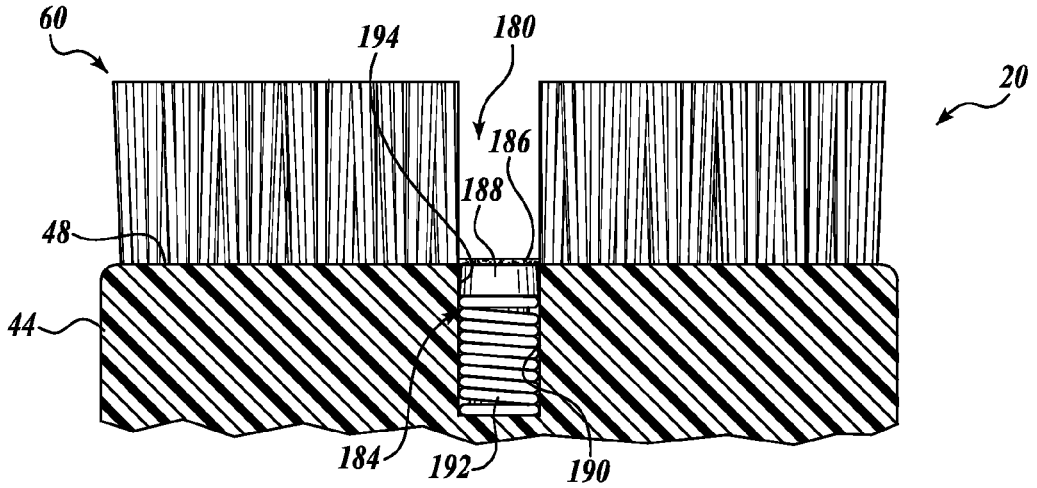
FIGS. 10A-10B are partial cross sectional views of a brush head that includes another example of a wear indicator in accordance with aspects of the present disclosure.
Figure 10B:
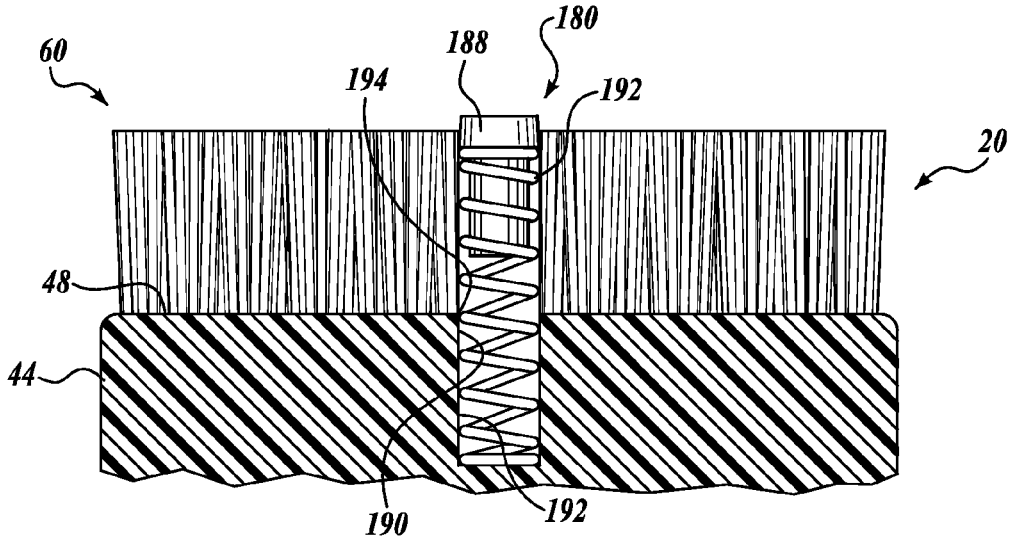

FIGS. 10A-10B illustrate another example of a wear indictor, generally designated 180, in accordance with another aspect of the present disclosure. As shown in FIG. 10A, the wear indicator 180 includes a mechanical "pop-up" device 184 overlaid by a wearable layer 186. In the embodiment shown in FIG. 10A, the "pop-up" device 184 can be formed by a piston-like member 188 disposed in an open ended, elongated cylindrical chamber 190 and biased outwardly via spring 192. The elongated cylindrical chamber 190 is formed in the body 44 of the brush head, oriented perpendicular to the outer surface 48, and has an opening 194 formed by or disposed at the outer surface 48.

When assembled, the piston-like member 188 is biased inwardly against the spring 192 in a stowed position as shown in FIG. 10A, and is restrained in the chamber 190 by a wearable layer 186 disposed over the opening 194. In some embodiments, the wearable layer 186 can be mounted or otherwise affixed over the opening 194 via adhesive, heat bonding, etc. In other embodiments, the wearable layer 186 can be printed over the opening 194 with the aid of an intermediate layer (not shown). When first applied over the opening 194, the wearable layer 186, either alone or in conjunction with the intermediate layer, is configured to overcome the biasing force of the spring 192. During use, as the wearable layer 186 wears, either via abrasion, loss of adhesion, solubility, or otherwise, the layer 186 becomes weaker, providing less resistance against the biasing force of the spring 192. Once the layer 186 weakens to a point that it can no longer overcome the biasing force of the spring 192, the biasing force of the spring 192 forces the piston-like member 188 through the layer 186 and into a deployed position shown in FIG. 10B. In its deployed position, the piston-like member 188 is visible to the user, thereby indicating to the user a recommendation that the brush head be replaced. To increase visibility of the piston-like member 188, the top of the piston-like member 188 can include a solid color, such as red.

Figure 11A:
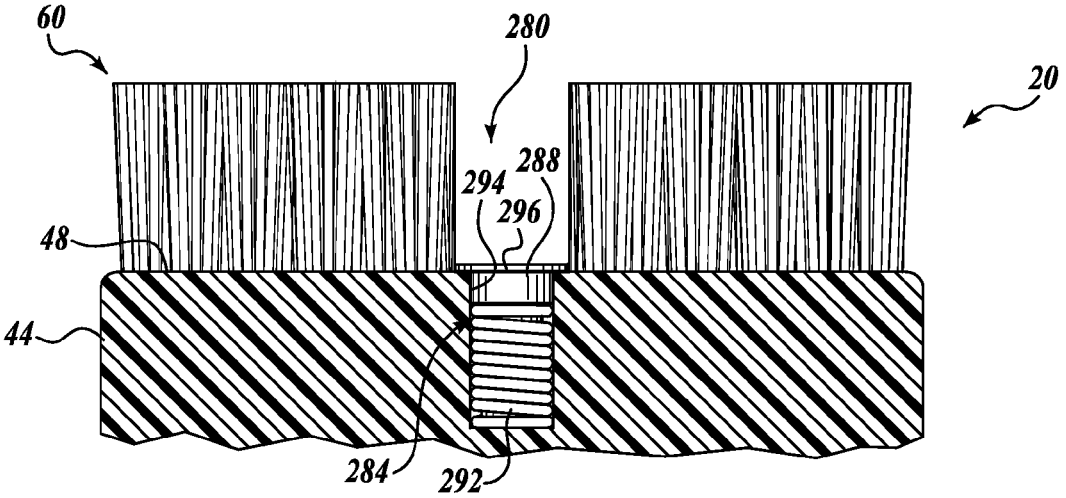
FIGS. 11A-11B are partial cross sectional views of a brush head that includes yet another example of a wear indicator in accordance with aspects of the present disclosure.
Figure 11B:
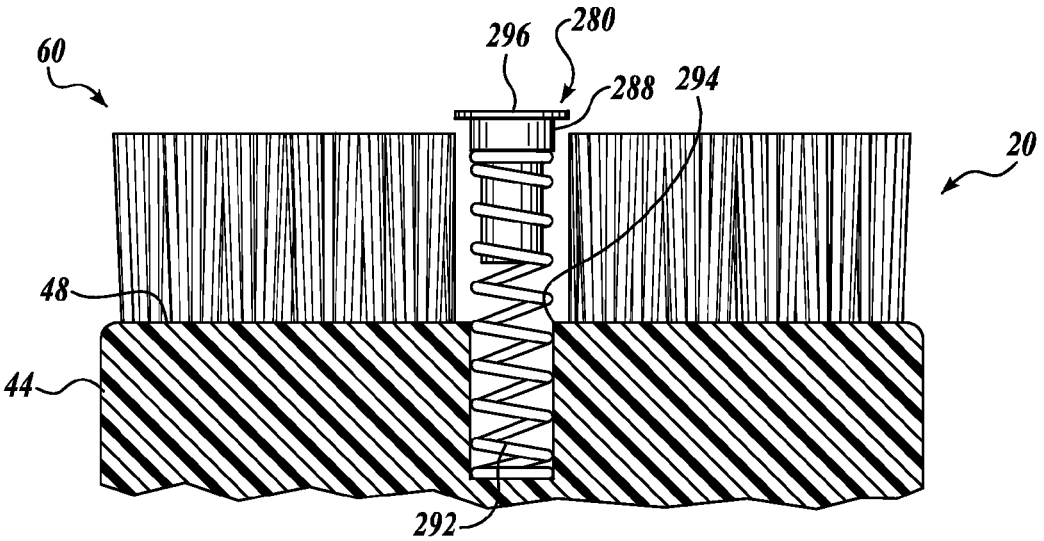

FIG. 11A-11B illustrate yet another example of a wear indictor, generally designated 280, in accordance with another aspect of the present disclosure. The wear indicator 280 is substantially similar in construction and operation as the wear indicator 180 of FIGS. 10A-10B except for the differences that will now be described. As shown in FIG. 11A, the wear indicator 280 includes a mechanical "pop-up" device 284. In this embodiment, the piston-like member 288 of the device 284 further includes an oversized or flanged head 296 that covers up or overlays the opening 294. In one embodiment, an adhesive configured to lose bonding strength by repeated exposure to water, skin care formulations, etc., can be employed to bond the lower surface of the head 296 directly or indirectly to the outer surface 48 of the brush head. Adhesives that lose adhesion over time can also be employed. During use, as the adhesive is exposed, for example, to water, skin care formulas, etc., the bond between the head 296 and the body 44 continually weakens until it can no longer overcome the biasing force of the spring 292. As a result, the biasing force of the spring 292 separates the device 284 from the body 44 and into a deployed position shown in FIG. 11B.

As stated above, examples of the brush head 20 are suitable for use with a personal care appliance. In that regard, one example of a personal care appliance 22 that may be employed to impart an oscillating motion to the workpiece 20 will be described in some detail. While the personal care appliance 22 is one type of appliance that can be practiced with embodiments of the present disclosure, it will be appreciated that the workpiece 20 is suitable for use with a wide range of oscillatory, rotational, and reciprocating motion generating devices.

Figure 12:
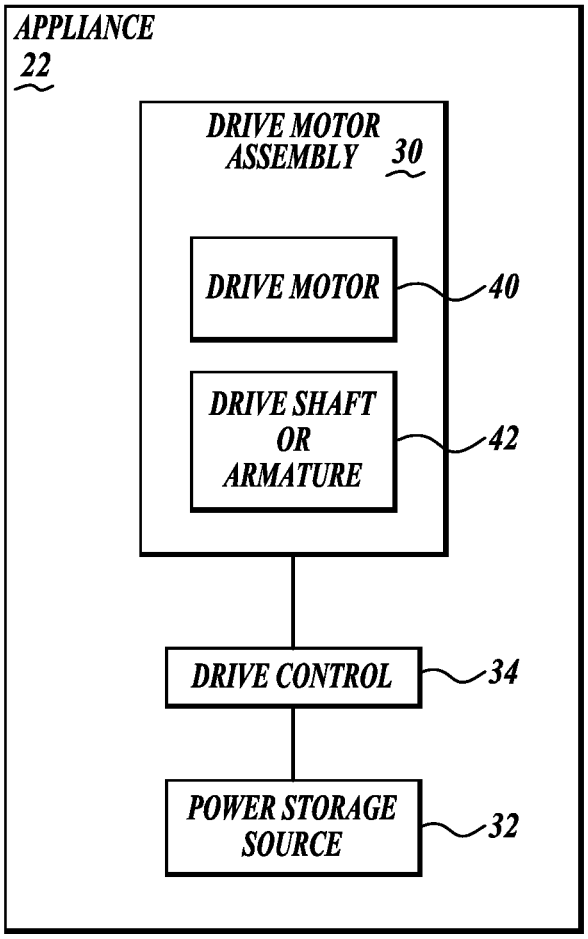
FIG. 12 illustrates in block diagrammatic form one example of the personal care appliance.

Turning now to FIGS. 1, 2 and 12, there is shown one example of the personal care appliance 22. The appliance 22 includes a body 24 having a handle portion 26 and a head attachment portion 28. The head attachment portion 28 is configured to selectively attach a workpiece or head, such as brush head 20, to the appliance 22. The appliance body 24 houses the operating structure of the appliance. As shown in block diagrammatic form in FIG. 12, the operating structure in one embodiment includes a drive motor assembly 30, a power storage source 32, such as a rechargeable battery, and a drive control 34 that includes an on/off button 36 (See FIG. 1) configured and arranged to selectively deliver power from the power storage source 32 to the drive motor assembly 30. In some embodiments, the drive control 34 may also include a power adjust or mode control buttons 38 (See FIG. 1) coupled to control circuitry, such as a programmed microcontroller or processor, which is configured to control the delivery of power to the drive motor assembly 30. The drive motor assembly 30 in some embodiments includes an electric drive motor 40 that drives the brush head 20, via a drive shaft or armature 42 and drive boss 52.

When the brush head 20 is mounted to the head attachment portion 28, the drive motor assembly 30 is configured to impart motion to the brush head 20. The drive motor assembly 30 may be configured to operate the brush head 20 at sonic frequencies, typically in the range of 40-350 Hz, oscillating the brush head 20 back and forth within a range or amplitude of 3-45 degrees. In some embodiments, as will be described in more detail below, the brush head 20 can be operated in loaded or unloaded conditions at frequencies from about 80 Hz to about 220 Hz and with a range or amplitude of about 6 degrees to about 20 degrees. It will be appreciated that the operation frequency and oscillation amplitude imparted to the cleansing workpiece 20 by the drive motor assembly 30 could be varied, depending in part on its intended application and/or characteristics of the brush head, such as its inertial properties, etc.

It should be noted that for purposes of this disclosure, terminology such as "upper," "lower," "vertical," "horizontal," "inwardly," "outwardly," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A workpiece for use with a motorized personal appliance, comprising:

a body having an outer surface;

a treatment applicator coupled to the outer surface of the body, wherein the treatment applicator is configured to apply treatment to a subject's skin;

a wear indication member configured to move to an indicating position with respect to the treatment applicator that indicates to a user a recommendation for replacement of the skin brush head after an amount of usage of the workpiece; and a biasing member associated with the wear indication member and a wear layer, wherein the wear indication member is configured to be moved to a stowed position against a biasing force of the biasing member, wherein the wear indication member is restrained in the stowed position via the wear layer.

2. The workpiece of claim 1, wherein the treatment applicator includes a plurality of bristles.

3. The workpiece of claim 2, wherein the wear indication member extends past the plurality of bristles in the indicating position.

4. The workpiece of claim 1, wherein the wear indication member is disposed on the outer surface of the body.

5. The workpiece of claim 1, wherein the wear layer is configured to wear based on one or more of abrasion, adhesion, and solubility.

6. The workpiece of claim 1, wherein the wear indication member includes an outwardly extending flange.

7. The workpiece of claim 6, wherein the flange is bonded to the outer surface of the body in the stowed position via an adhesive, wherein the adhesive is configured to lose bonding strength by repeated use of the workpiece.

8. The workpiece of claim 7, wherein the adhesive is configured to lose bonding strength by repeated exposure to liquid.

9. A powered treatment device, comprising:

a powered handle having a motor;

a skin brush head removably mounted to the powered handle and configured to be moved by the motor, wherein the skin brush head includes a body having an outer surface;

a plurality of bristles that extend outwardly from the outer surface of the body, and a wear indicator associated with the skin brush head, the wear indicator including a wear indication member configured to move to an indicating position with respect to the plurality of bristles for indicating to a user a recommendation for replacement of the skin brush head after an amount of usage of the skin brush head, wherein the wear indicator further includes a biasing member and a wear layer, wherein the indication member is restrained in a biased position against the biasing member via the wear layer.

10. The powered treatment device of claim 9, wherein the wear indicator is disposed on the outer surface of the body.

11. The powered treatment device of claim 9, wherein the wear layer is configured to weaken based on repeated use, wherein when the biasing force of the biasing member exceeds the restraining force of the wear layer, the indication member moves via the biasing force from the biased position to said indicating position in which the indication member projects outwardly of the body and adjacent the plurality of bristles.

12. The powered treatment device of claim 9, wherein the plurality of bristles are positioned in surrounding relationship with respect to the wear indication member.

13. A powered treatment device, comprising:

a powered handle having a motor;

a skin brush head removably mounted to the powered handle and configured to be moved by the motor, wherein the skin brush head includes a body having an outer surface;

a plurality of bristles that extend outwardly from the outer surface of the body, and a wear indicator associated with the skin brush head, the wear indicator including a wear indication member configured to move to an indicating position with respect to the plurality of bristles for indicating to a user a recommendation for replacement of the skin brush head after an amount of usage of the skin brush head, wherein the wear indicator includes a biasing member, wherein a portion of the indication member is bonded to the outer surface of the body in a biased position via an adhesive, and wherein the adhesive is configured to lose bonding strength over a preselected period of time.

14. The powered treatment device of claim 13, wherein the adhesive is configured to lose bonding strength by repeated exposure to liquid.

* * * * *